United States Patent [19]

McJones et al.

[11] 4,425,893

[45] Jan. 17, 1984

[54] FUEL INJECTION

[75] Inventors: Robert W. McJones, Palos Verdes, Calif.; Robert S. McCarty, Phoenix, Ariz.; Joseph S. Cardillo, Palos Verdes Est., Calif.

[73] Assignee: The Garrett Corporation, Los Angeles, Calif.

[21] Appl. No.: 327,827

[22] Filed: Dec. 7, 1981

[51] Int. Cl.[3] ..... F02M 39/00

[52] U.S. Cl. ..... 123/446; 239/88

[58] Field of Search ..... 123/446, 447, 467; 239/88, 89, 90, 91, 92, 93, 95

[56] References Cited

U.S. PATENT DOCUMENTS

| | | | |
|---|---|---|---|
| 2,347,363 | 4/1944 | Palumbo | 239/95 |
| 3,416,506 | 12/1968 | Steiger | 123/467 |
| 3,615,043 | 10/1971 | Hussey et al. | 123/446 |
| 3,908,621 | 9/1975 | Hussey | 123/447 |
| 4,080,942 | 3/1978 | Vincent et al. | 123/447 |
| 4,215,662 | 8/1980 | Nozaki et al. | 123/447 |
| 4,275,693 | 6/1981 | Leckie | 123/447 |
| 4,364,360 | 12/1982 | Eheim et al. | 123/450 |

FOREIGN PATENT DOCUMENTS

| | | | |
|---|---|---|---|
| 543825 | 7/1957 | Canada | 239/92 |
| 1262089 | 2/1972 | United Kingdom | 123/446 |

*Primary Examiner*—Charles J. Myhre
*Assistant Examiner*—Magdalen Moy
*Attorney, Agent, or Firm*—Terry L. MIller; Albert J. Miller

[57] ABSTRACT

A method and apparatus for injecting timed pulses of fuel of variable quantity into a high speed compression-ignition engine.

40 Claims, 6 Drawing Figures

10
14
16
18
20
22
24
26
28
30
32
34
36
38
40
42
44
46
48
50
52
54
56
58
60
62
63
64
66
68
70
72
74
76
78
80
82
84
86
88
90
92
94
96
98
100
102
104
106
108
110
112
114
116
118
120
122
124
126
128
130
132
134
136
138
2B
F
E
O
P

PRESSURE VS. TIME – CHAMBERS 74 AND 94

PRESSURE VS. TIME – CHAMBERS 64; 74, 94, AND 34, 36, 98

SUPPLY PRESSURE

INJECTION PRESSURE

VENT PRESSURE

A. – INJECTION PULSE BEGINS

B. – INJECTION PULSE ENDS

C. – CHAMBER 94 BEGINS TO REFILL

FUEL INJECTION

The Government has rights in this invention pursuant to Contract No. F33657-77-C-0391 awarded by the U.S. Air Force.

BACKGROUND AND SUMMARY OF THE INVENTION

This invention relates to a method and apparatus for injecting fuel into an internal combustion engine. More particularly, this invention relates to a method and apparatus for injecting fuel pulses of variable quantity directly into a combustion chamber of a high speed, compression-ignition diesel engine in timed relation to the rotational position of the engine crankshaft.

A number of conventional fuel injection systems have been used to inject fuel into internal combustion engines. However, conventional fuel injection systems suffer from a number of recognized deficiencies, especially when applied to high speed engines.

One of these recognized deficiencies is the functional complexity of conventional fuel injection systems which require the precise cooperation of many component parts. Further, many of the component parts are themselves structurally and functionally complex. Such multi-layered complexity adds to the manufacturing, assembly and maintenance time and costs of conventional fuel injection systems as well as increasing the probability of malfunction.

Another recognized deficiency of conventional fuel injection systems comes to light when an attempt is made to apply these systems to a diesel engine capable of high speed operation. Because the cyclic time of a high speed engine is very short, one or more of the component parts of conventional fuel injection systems are unable to function properly at the high cyclic rate. Consequently, conventional fuel injection systems are unable to properly supply fuel to a high speed engine so that the engine fails to fully attain its potential for speed and power output.

One symptom of this shortcoming is that diesel engines have traditionally been thought of as comparatively low-speed, low specific-horsepower engines best suited for stationary use or for heavy-duty vehicular use. Thus, until recently, the spark ignition engine has been the preferred engine for automotive use. However, recognition of the inherent thermodynamic superiority of the diesel engine has led to its application to automotive vehicles. Further, the need for light weight, fuel efficient vehicles has led to the development of comparatively small-displacement, high specific-horsepower output diesel engines employing supercharging or turbocharging to enable the diesel engine to produce horsepower somewhat comparable to a spark-ignition engine. However, such engines have been unable to attain their full speed potential because of the deficiencies of conventional fuel injection systems.

One of the limiting deficiencies of conventional fuel injection systems becomes vexingly apparent at high engine speeds. Because conventional fuel injection systems typically use a plunger to pressurize a selected quantity of fuel in a measuring chamber from a comparatively low pressure to an injection pressure opening a valve to begin injection, the compressibility of the fuel imposes an inherent delay between stroking of the plunger and the beginning of injection. At low engine speeds delays caused by compressibility of the fuel do not pose an insurmountable obstacle to successful use of conventional fuel injection systems. However, as engine speed increases the flexibility of system components along with inertia and momentum effects combine with the compressibility of the fuel so that the selected quantity of fuel cannot be raised to injection pressure and injected into a combustion chamber of the engine in the time available. Experience has shown that in conventional fuel injection systems the liquid fuel has an apparent compressibility of about 0.5 percent per 1000 psi. of pressure applied to the fuel. About 0.15 percent is attributable to elastic deformation of component parts of the fuel injection system with the remainder representing actual compression of the liquid fuel. Thus, it can be seen that a considerable amount of "slack" must be removed from a conventional fuel injection system before each injection pulse can begin. For example, if the pressure of the measured quantity of fuel is increased by 10,000 psi. to reach injection pressure, it will decrease in apparent volume by about 5 percent before reaching injection pressure. Thus, the fuel injection system must provide an additional 5 percent of plunger movement to take up the "slack" in the system and provision must be made to allow for the timing of the injection pulse to compensate for the concommittant delay caused by compression of the fuel.

A further manifestation of fuel compressibility arises in those conventional fuel injection systems having the plunger located some considerable distance from the injection nozzle. When the injection nozzle valve closes at the end of an injection pulse, a pressure wave is created in the fuel trapped behind the nozzle. This pressure wave travels through a conduit to the plunger where it is reflected back to the injection nozzle. Upon arriving at the injection nozzle, the pressure wave may have sufficient amplitude to momentarily unseat the nozzle valve so that fuel dribbles into the combustion chamber at an undesirable time. Such fuel dribbling adversely effects the exhaust emissions of the engine as well as decreasing its fuel efficiency.

Another aspect of high speed diesel engines is that they are generally of comparatively small displacement with small pistons and cylinders so that space around the combustion chamber in the head of these engines is very limited. Thus, in order to deliver an appropriate quantity of fuel to a combustion chamber in the time available while using a necessarily small injector nozzle, comparatively high injection pressures must be used. For example, injection pressures of about 20,000 psi. are employed in some conventional fuel injection systems. Of course, increased injection pressures cause increased compression of the fuel and exacerbate the deficiencies outlined above.

U.S. Pat. Nos. 3,465,737; 3,859,973; 3,908,621; 3,913,548; 3,936,232; 3,951,117; 3,968,779; 3,983,855; 4,019,835; 4,050,433; 4,138,981 and 4,149,506 illustrate examples of conventional fuel injection systems.

In view of the deficiencies of conventional fuel injection systems it is a primary object for this invention to provide a fuel injection apparatus and method for a high speed diesel engine.

Another object for this invention is to provide a fuel injection apparatus and method which is comparatively simple in structure and function.

Another object for this invention is to provide a fuel injection method and apparatus which avoids the limitations imposed on conventional fuel injection systems by the compressibility of liquid fuels.

Still another object is to provide a fuel injection method and apparatus which does not rely upon the pressurization of a measured quantity of fuel to open an injection nozzle to begin injection of a fuel pulse into an engine.

Another object for this invention is to provide a fuel injection apparatus and method wherein an injection nozzle is opened by creating a fluid pressure differential across a plunger member movable to open the nozzle.

Still another object for this invention is to provide a fuel injection apparatus and method which does not rely upon a pressure increase of a measured quantity of fuel to deliver the measured quantity of fuel through an injection nozzle to a combustion chamber.

Another object for this invention is to provide a fuel injection method and apparatus wherein a quantity of pressurized fuel at a determined pressure level is measured and delivered through an injection nozzle to a combustion chamber substantially at the determined pressure level.

Yet another object for this invention is to provide a fuel injection apparatus and method wherein a plunger is moved by pressurized fluid at a determined pressure level to deliver a measured quantity of fuel to a combustion chamber.

These and other objects and advantages of this invention will be apparent in light of the following detailed description of two preferred embodiments of the invention.

DETAILED DESCRIPTION OF THE PREFERRED EMBODIMENTS

Figure 1:
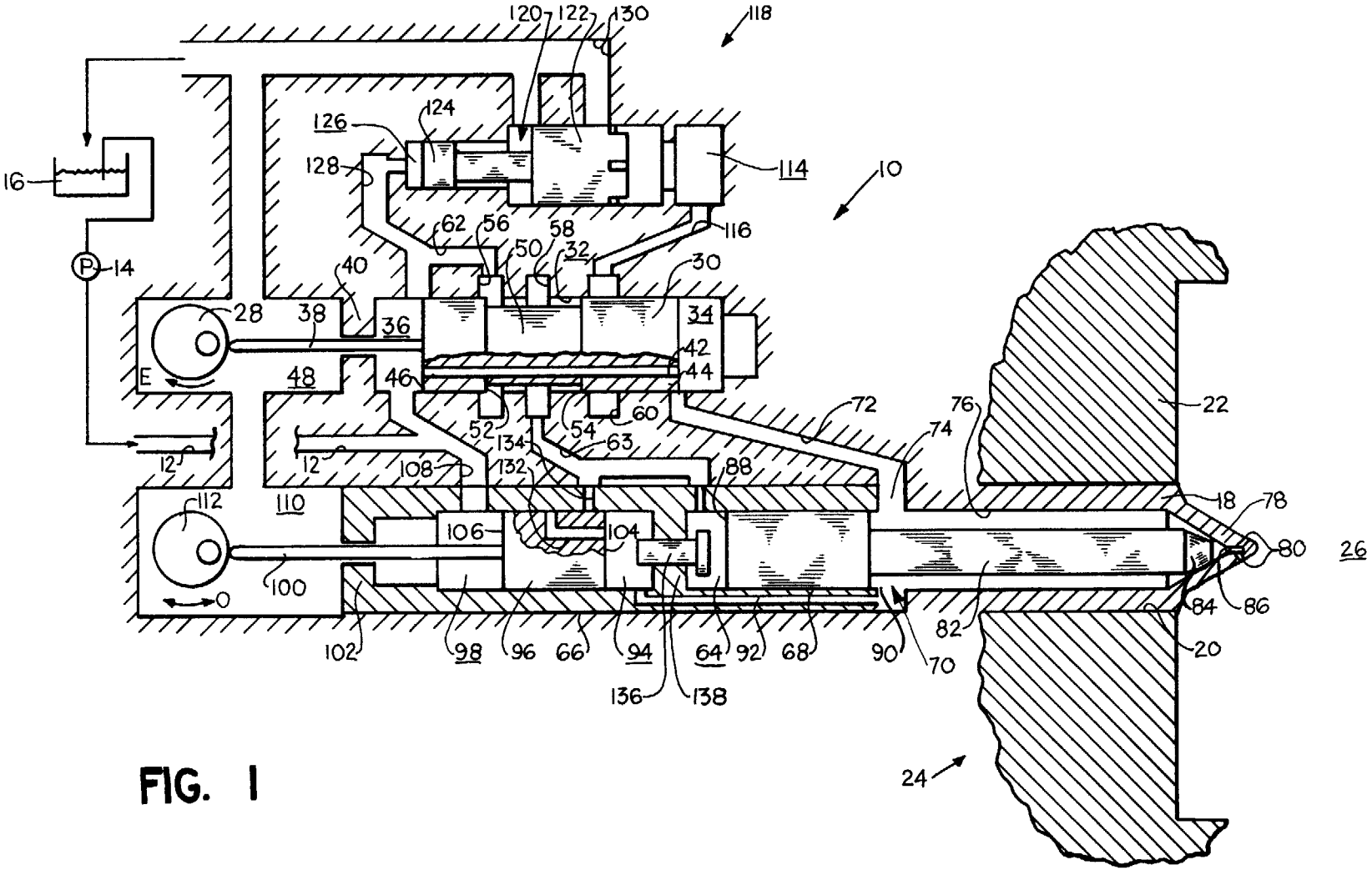
FIGS. 1 and 2 schematically illustrate one embodiment of the invention with parts thereof in alternate operative positions.

FIG. 1 schematically illustrates a fuel injector 10 according to a preferred embodiment of the invention. The fuel injector 10 receives pressurized fuel at an inlet 12 from a pump 14 drawing fuel from a tank 16. The pump 14 takes in fuel at ambient atmospheric pressure from tank 16 and delivers the fuel to inlet 12 at a pressure of approximately 25,000 psi. Fuel injector 10 includes a nozzle portion 18 extending through a bore 20 defined in a wall 22 of a high-speed two-cycle diesel engine 24 (only a portion of which is illustrated). The nozzle portion 18 projects into a combustion chamber 26 of the engine 24. The fuel injector 10 injects pulses of fuel of variable quantity into the combustion chamber 26 in timed relation with the operation of engine 24. One pulse of fuel is injected for each power cycle of operation of the engine 24. Accordingly, when the engine 24 operates at a high speed the injector 10 must supply many precisely timed and measured pulses of fuel each second. For example, when engine 10 operates at 8000 R.P.M. injector 10 must supply 133 fuel pulses each second.

In order for the fuel injector 10 to operate in timed relation with the engine 24, injector 10 includes a cam member 28 which is rotatably driven by the engine (as is illustrated by arrow E). The cam member 28 reciprocably drives a valve member 30 within a chamber 32. The valve member 30 divides the chamber 32 into a pair of compartments 34 and 36 and defines a stem 38 sealingly extending through an end wall 40 of the chamber 32. Chamber 36 receives pressurized fuel via inlet 12 while the chamber 34 receives pressurized fuel via a passage 42 defined by the valve member 30. The valve member 30 defines a pair of opposed faces 44 and 46 which differ in effective area according to the cross sectional area of the stem 38. Accordingly, the valve member 30 defines a differential area at stem 38 which is exposed to ambient pressure in a chamber 48 communicating with the fuel tank 16. Thus, the stem 38 is continuously biased into engagement with the cam member 28 by pressurized fuel within the chambers 34 and 36.

The valve member 30 also defines an axially extending circumferential groove 50 forming a pair of spaced apart valving edges 52 and 54. Three annular grooves 56,58 and 60 circumscribe the valve member 30. The groove 56 receives pressurized fuel from the chamber 36 via a passage 62. In a first position of the valve member 30, as illustrated viewing FIG. 1, pressurized fuel communicates from the groove 56 to the groove 58 via the groove 50 while the valving edge 54 is positioned leftwardly of the groove 60 to prevent communication of pressurized fuel to the latter.

Pressurized fuel communicates from groove 58 via a passage 63 to a chamber 64 defined by the cooperation of a sleeve member 66 and a movable plunger member 68. The plunger member 68 is part of a valve member generally referenced 70. Pressurized fuel also communicates from chamber 34 via a passage 72 to a chamber 74 defined adjacent an end of plunger member 68 opposite the chamber 64. A stepped bore 76 extends within the nozzle portion 18 from the chamber 74 into a tip section 78 of the nozzle portion 18. The tip section 78 defines a pair of small passages 80 communicating the bore 76 with the combustion chamber 26. The valve member 70 includes a stem 82 extending in the bore 76 and a valve element 84 at the right end of the stem 82, viewing FIG. 1. The valve element 84 sealingly engages the tip section 78 at a step 86 of the bore 76 to prevent communication of a pressurized fuel into the combustion chamber 26. The plunger member 68 defines a pair of opposed faces 88 and 90 differing in effective area substantially according to the area defined at the sealing engagement of the valve element 84 with the step 86. Thus, the valve element 84 defines a differential area for the valve member 70. The differential area of valve member 70 is exposed to fluid pressure within the combustion chamber 26 via passages 80.

During the compression stroke of the engine 24, fluid pressure in the chamber 26 may reach several hundreds of pounds per square inch. On the other hand, the opposed faces 88 and 90 of the plunger member are exposed to pressurized fuel at a pressure of about 25,000 psi. Because the area of the face 88 exceeds the area of the face 90 by an amount substantially equal to the differential area of valve element 84, the valve element is biased into sealing engagement with the step 86 by pressurized fuel in opposition to the fluid pressure in the combustion chamber 26.

A branch passage 92 leads from the chamber 74 to a variable-volume chamber 94. The variable-volume chamber 94 is defined by the cooperation of a movable piston member 96 with the sleeve 66. The piston member 96 also cooperates with the sleeve member 66 to define a cavity 98. Piston member 96 defines a stem 100 sealingly and movingly extending through an end wall 102 of the sleeve member 66. Thus, the piston member 96 defines a pair of opposed faces 104 and 106 which differ in effective area according to the cross sectional area of the stem 98. Accordingly, the stem 100 defines a differential area for the piston member 96. The variable-volume chamber 94 receives pressurized fuel via the branch passage 92 while the cavity 98 receives pressurized fuel from the inlet 12 via a passage 108. The differential area of stem 100 is exposed to ambient pressure in a chamber 110 so that pressurized fuel in chamber 94 acting on face 104, which defines the larger area of the two opposed faces of piston 96, biases the piston member 96 and stem 100 leftwardly, viewing FIG. 1. The stem 100 extends in the chamber 110 to movably engage a rotatable cam member 112. The cam member 112 is rotatable in response to an operator input to selectively vary the volume of variable-volume chamber 94 (as is illustrated by arrow O).

Figures 2, 2B:
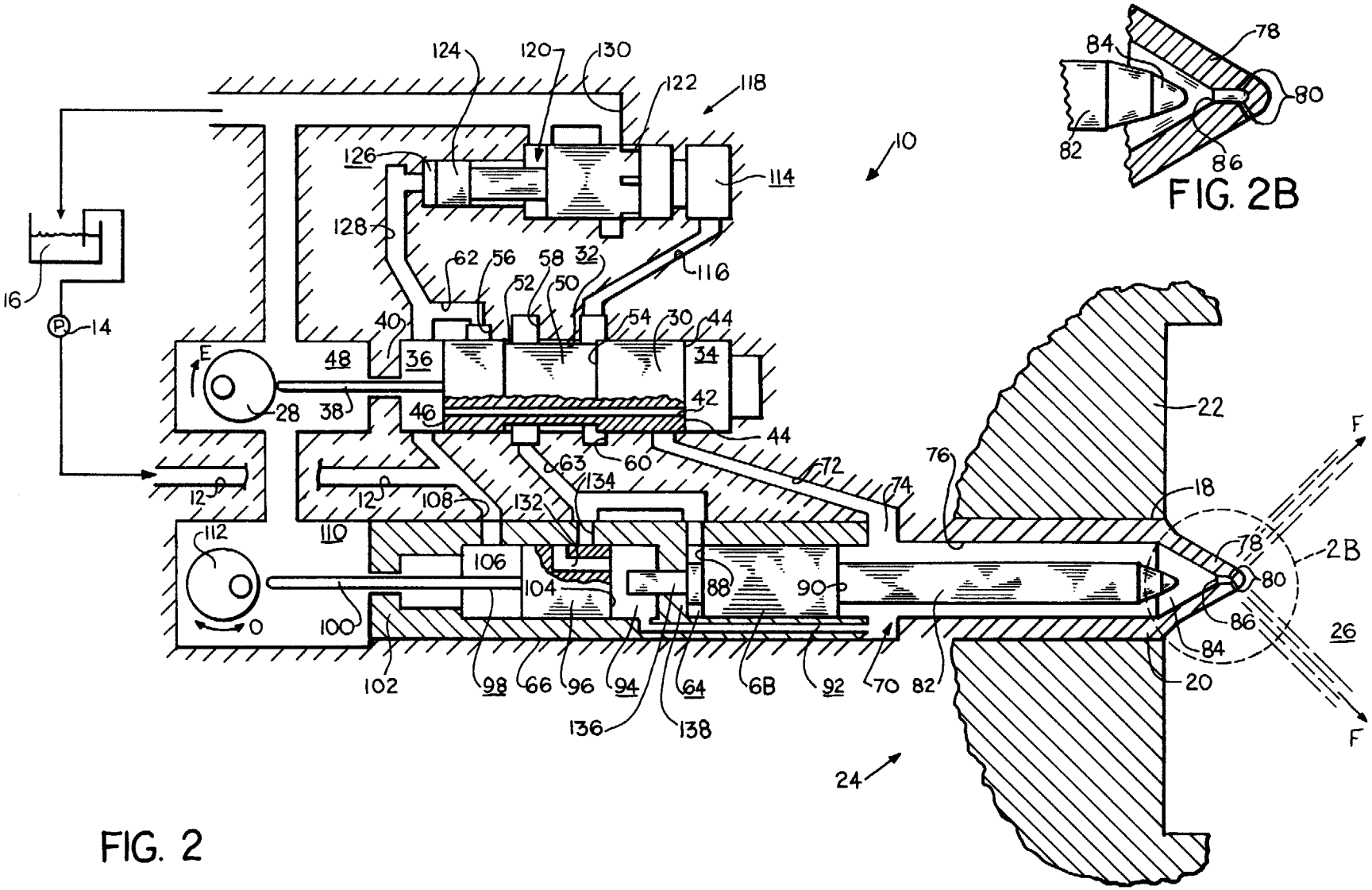
FIG. 2B is an enlarged fragmentary view of an encircled portion of FIG. 2.

Turning now to FIG. 2, as the engine 24 rotates cam member 28 to reciprocate the valve member 30 to a second position, as is illustrated, a number of events take place in sequence. First, the face 44 of valve member 30 traverses the passage 72 to cut off communication of pressurized fuel to the chambers 74 and 94. Secondly, the valving edge 52 of the valve member 30 moves rightwardly of the annular groove 56 to cut off communication of pressurized fuel to the chamber 64 via groove 50, groove 58, and passage 63. Lastly, the valving edge 54 moves rightwardly of the groove 60 to vent pressurized fuel from the chamber 64 to a chamber 114 via a passage 116.

The chamber 114 is defined in a vent regulator 118 having a stepped differential piston 120 reciprocably mounted therein. The piston 120 includes a large diameter end 122 exposed to the chamber 114 and a small diameter end 124 exposed to a chamber 126 receiving pressurized fuel via a passage 128. The small diameter end 124 of piston 120 defines an area exposed to pressurized fuel which is about 44 percent of the area defined by the large diameter end 122. Thus, pressurized fuel in chamber 126 moves the piston member 120 relative to a port 130 leading to the tank 16 to maintain the pressure in chamber 114 at about 44 percent of the fuel pressure supplied to the injector 10 at inlet 12. Consequently, when the fuel pressure supplied to inlet 12 is 25,000 psi, chamber 114 is maintained at substantially 11,000 psi.

When pressurized fuel is vented from the chamber 64 to chamber 114, the pressure in chamber 64 drops from about 25,000 psi to about 11,000 psi while the pressure in chamber 74 remains at about 25,000 psi. Therefore, fuel pressure in chamber 74 acts on plunger member 68 to very quickly move the valve element 84 to an open position via stem 82, as is illustrated viewing FIG. 2.

As soon as the valve element 84 opens, the fuel in chambers 74 and 94 begins to escape into the combustion chamber 26, as illustrated by arrows F, to begin a fuel injection pulse so that the pressure in chambers 74 and 94 decreases. However, the left face 106 of piston member 96 is exposed to pressurized fuel in chamber 98 so that as soon as the pressure in chamber 94 decreases sufficiently to overcome the effect of the differential area of stem 100, the plunger member 96 moves rightwardly to displace fuel from the chamber 94 into the combustion chamber 26. Because the differential area defined by stem 100 is a relatively small portion of the area of face 102 of the piston 96, the piston moves rightwardly to maintain fuel in the chambers 74 and 94 substantially at a pressure of 25,000 psi. Consequently, the fuel from chamber 94 is injected into the combustion chamber 26 very quickly despite the comparatively small size of the nozzle portion 18 and of passages 80. Further, fuel in the chambers 74 and 94 is maintained at substantially a constant pressure during the fuel injection pulse.

When the piston member 96 and stem 100 have moved rightwardly through a determined distance to displace a determined quantity of fuel from the chamber 94 into the combustion chamber 26, two events occur in rapid sequence. First, a passage 132 defined by the piston member 96 aligns with a port 134 to vent pressurized fuel from the chamber 94 to chamber 114 of the vent regulator 118 via the passages 63 and 116. Consequently, the fuel pressure in chambers 74 and 94 drops from substantially 25,000 psi to about 11,000 psi so that fuel delivery to the combustion chamber 26 substantially ceases. Secondly, the right face 104 of piston member 96 makes contact with a movable shuttle member or abutment member 136 which is sealingly disposed in a center wall 138 of the sleeve member 66. The piston member 96 is now exposed at its left face 106 to pressurized fuel at about 25,000 psi and at its right face 104 to fuel at about 11,000 psi. Consequently, the piston member 96 forcibly drives the shuttle member 136 rightwardly. The shuttle member 136 in turn drives the valve member 70 rightwardly to seat the valve element 84 at the step 86 to positively terminate the fuel injection pulse.

As the engine 24 continues to rotate the cam member 28, the valve member 30 reciprocates leftwardly to its position illustrated in FIG. 1 to terminate venting of the chambers 64 and 94 and to restore communication of pressurized fuel from inlet 12 to chamber 64. Consequently, the pressurized fuel in chamber 64 insures that the valve member 70 remains seated on the step 86. Further, the right face 44 of valve member 30 moves leftwardly of the passage 72 to restore communication of pressurized fuel to chamber 94 via passage 72, chamber 74, and passage 92. Because of the differential area defined by the stem 100 for the piston member 96, these latter two parts move leftwardly until the stem 100 contacts the cam member 112 to measure a determined quantity of pressurized fuel into the chamber 94.

Figure 3:
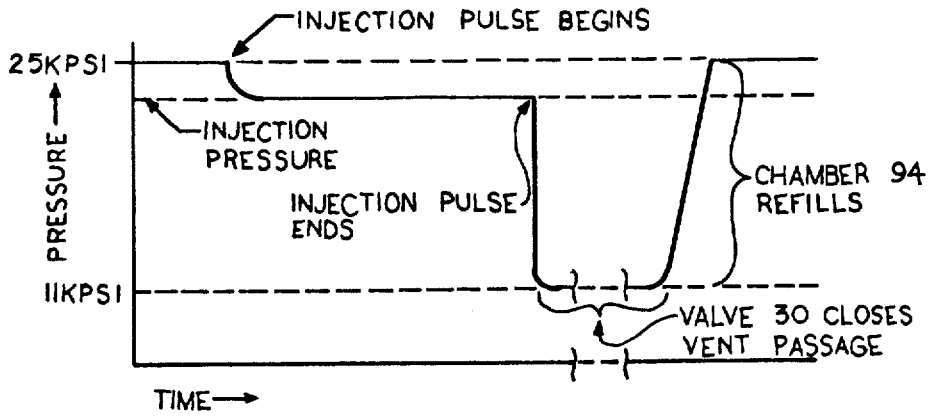
FIGS. 3 and 4 illustrate graphs depicting fuel pressure levels at a number of points in the invention as a function of time.
Figure 4:
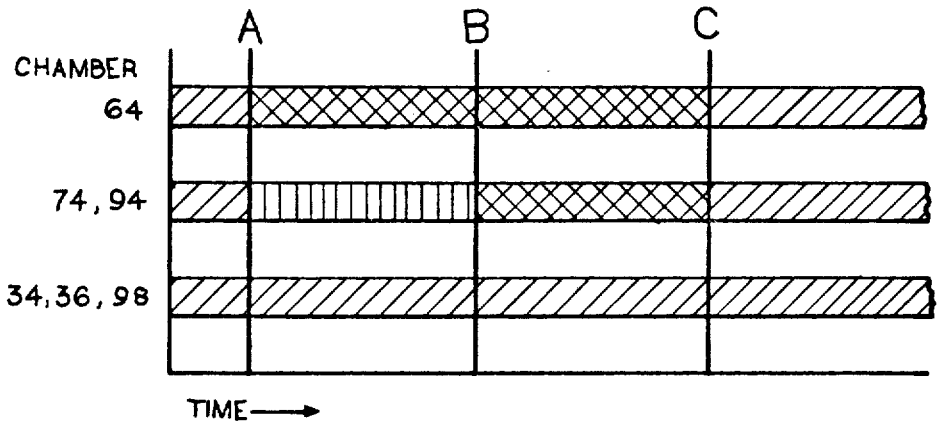

FIGS. 3 and 4 present the above information in graphical form to assist the reader to understand the time sequency of the above-described events. FIG. 3 depicts the pressure in chambers 74 and 94 during a complete injection cycle as a function of time. It will be noted upon examination of FIG. 3 that the injection pressure (the pressure in chambers 74 and 94) remains substantially constant throughout the injection pulse at a level only slightly below the supply pressure of 25,000 psi. Thus, the compressibility of the liquid fuel has little effect upon the injector 10 because no increase of the fuel pressure above supply pressure or compression of the fuel is necessary before an injection pulse can begin. FIG. 4 depicts the pressure levels of the chambers 64; 74,94 and 34,36,98 as a bar chart progressing rightwardly with time. Upon examination of FIG. 4, it will be noted that the chambers 34, 36 and 98 continuously receive pressurized fuel at supply pressure i.e., at the pressure supplied to inlet 12. Pressure in these first two chambers provides the driving force to insure that the valve member 30 follows the cam member 28 to reciprocate in unison with operation of the engine 24. Pressure in the chamber 98 provides the driving force to move the plunger 96 to inject fuel into the combustion chamber 26. It will be seen that the pressure level of chamber 64 is varied between supply pressure and vent pressure while the chambers 74 and 94 sequently vary between supply pressure, injection pressure, and vent pressure.

In view of the above, it is easily perceived that the injector 10 injects one pulse of fuel into the combustion chamber 26 for each revolution of cam member 28. For a two-cycle diesel engine, cam member 28 is drivingly coupled to the engine crankshaft to rotate at a one-to-one ratio therewith. Further, the quantity of fuel injected during each pulse is determined by the position of the cam member 112. Thus, an operator may easily vary the fuel injection quantity, and the engine's power output, simply by rotating the cam member 112.

Further, examination of FIGS. 1 and 2 will reveal that the injector 10 is totally devoid of springs or other resilient members used to bias parts in a particular direction. In other words, the use of resilient members which may fatigue and weaken or break during use of the injector, particularly at high engine speeds, is avoided by the invention. Instead, the injector 10 employs differential areas defined on the valve members 30 and 70 and on piston member 96 which are acted upon by pressurized fuel. The pressurized fuel is continuously renewed by pump 14 as it is consumed by the engine 24. Thus, it will be understood that there is only a remote possibility of injector 10 malfunctioning.

A further aspect of injector 10 which enhances its reliability and that of the engine 24 is that all leakage paths within the injector lead to the tank 16, as by the chambers 48 and 110. Consequently, it is believed that the injector 10 will continue to function properly even if sealing integrity at the stems 38 and 100 is compromised. As a result, minor leaks which would cause a conventional fuel injection system to malfunction or to require maintenance are tolerated by injector 10 without difficulty.

Figure 5:
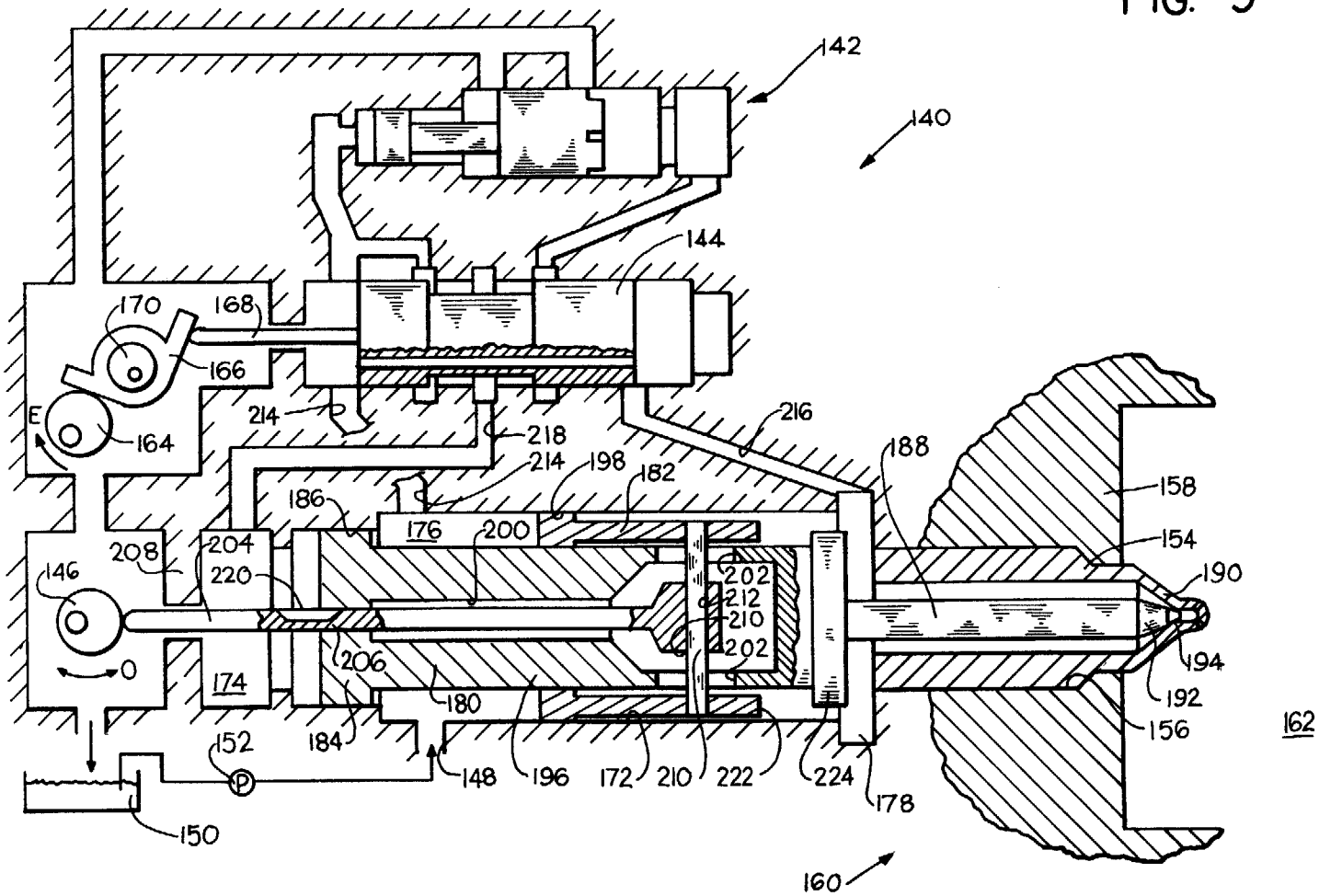
FIG. 5 schematically illustrates an injector according to an alternative embodiment of the invention.

FIG. 5 schematically illustrates an injector 140 according to an alternative embodiment of the invention. The injector 140 includes many features which are fully analogous in structure and function to features of the injector 10 of FIGS. 1 and 2. For example, the injector 140 includes a vent regulator 142, a valve member 144, a cam member 146 and an inlet 148 which are analogous to the features 118, 30, 112 and 12, respectively, of the first embodiment of the invention. The injector 140 receives fuel at inlet 148 from a tank 150 via a pump 152 supplying a fuel pressure of about 25,000 psi. Injector 140 also includes a nozzle portion 154 extending through a bore 156 defined by a wall 158 of an engine 160 and opening to a combustion chamber 162. However, the injector 140 includes an engine-driven cam member 164 reciprocably driving the valve member 144 via an L-shaped lever 166 engaging a stem 168 of the valve member 144. The L-shaped lever 166 is rotatably carried upon a rotatable eccentric member 170. Rotation of the eccentric member 170 selectively varies the phasing of reciprocation of valve member 144 with respect to operation of the engine 160. The eccentric member 170 is rotatable in response to an operator input so that the timing of fuel injection pulses to the combustion chamber 162 is variable.

The injector 140 includes a stepped bore 172 which is divided into three variable-volume compartments or chambers 174, 176, and 178 by a movable plunger member 180 cooperating with a relatively movable annular piston member 182. The plunger member 180 includes an enlarged head portion 184 which is sealingly and movably received in a portion 186 of the bore 172 to bound the chamber 174. Plunger member 180 also includes a stem portion 188 extending in the bore 172 to a tip section 190 of the nozzle portion 154. The stem 188 terminates in a tapering valve element 192 which is sealingly engageable with a step 194 of the bore 172. The annular piston member 182 movably circumscribes and sealingly cooperates with a central portion 196 of the plunger member 180. Piston member 182 also sealingly and movably cooperates with a portion 198 of the bore 172 to bound the chambers 176 and 178. The plunger member 180 defines an axially extending stepped bore 200 and a pair of opposed elongate slots 202 opening from the bore 200 to the chamber 178. A stem member 204 is movably received in the bore 200. Stem member 204 sealingly passes through a portion 206 of the bore 200 and also sealingly movingly passes through and end wall 208 of the bore 172 to engage the cam member 146. A pin 210 engages the piston member 182 and movably passes through the slots 202 to engage the stem member 204 at a bore 212. Thus, the piston member 182 and stem member 204 are coupled for movement in unison.

The inlet 148 opens to the chambers 176 so that chamber 176 continuously receives pressurized fuel form the pump 152. A passage 214 leads from the chamber 176 to the left end of the valve member 144 to supply pressurized fuel thereto. A passage 216 leads from the right end of valve member 144 to the chamber 178 to supply fuel to the latter. The chamber 174 communicates with the center of valve member 144 via a passage 218.

In a first position of the valve member 144, as is illustrated, pressurized fuel communicates with chambers 174 and 178. Examination of FIG. 5 will show that the plunger member 180 defines a differential area at the sealing engagement of the valve element 192 with the step 194. Consequently, pressurized fuel holds the valve element 192 of the plunger member 180 in sealing engagement with the step 194. Further, the stem member 204 defines a differential area for the annular piston member 182 according to the cross sectional area of the stem member 204 at the wall 208. Accordingly, the piston member is biased leftwardly by pressurized fuel so that the stem member 204 engages the cam member 146.

When the engine 160 rotates the cam member 164 to reciprocate the valve member 144 rightwardly, the valve member 144 closes communication of pressurized fuel to the chambers 174 and 178 and sequentially vents the chamber 174 to the vent regulator 142. Thus, the fuel pressure in chamber 174 decreases to about 11,000 psi to shift the plunger member 180 leftwardly and unseat the valve element 192. Pressurized fuel escapes from the chamber 178 into the combustion chamber 162 to begin a fuel injection pulse. However, as soon as the fuel pressure in chamber 178 decreases sufficiently for fuel pressure in chamber 176 to overcome the effect of the differential area of stem member 204, the piston member 182 is driven rightwardly by pressurized fuel to displace fuel from chamber 178 into the combustion chamber 162. Upon a determined movement of the piston member 182 and a corresponding displacement of fuel from chamber 178 into combustion chamber 162 two events occur in rapid sequence. First, a notch 220 on the stem member 204 moves through the bore portion 206 to open communication from chamber 178 to the vent regulator 142 via chamber 174. Second, an end edge 222 of piston member 182 engages a radially enlarged portion 224 of plunger member 180 driving the latter into sealing engagement at its valve element 192 with the step 194 and ending the fuel injection pulse.

When the engine 160 reciprocates the valve member 144 to its position illustrated in FIG. 5, communication of pressurized fuel to chambers 174 and 178 is restored. Thus, pressurized fuel drives the piston member 180 leftwardly to measure a determined quantity of pressurized fuel into the chamber 178 dependent upon the position of cam member 146.

It will be apparent in light of the above that this invention provides a method and apparatus for injecting fuel into a high speed diesel engine. However, the invention is also practicable for use with other types of engines. For example, the invention may be used with diesel engines designed for lower speed operation or with spark-ignition engines. Thus, the recitation that the injectors of FIGS. 1, 2 and 5 receive pressurized fuel at about 25,000 psi should be considered as illustrative only. Injectors according to this invention are usable at lower fuel pressures and can also accommodate higher pressures, if necessary, in order to supply fuel to a very high speed engine. While this invention has been described with reference to two preferred embodiments thereof, such reference should not be construed as a limitation upon the invention. The invention is intended to be limited only by the spirit and scope of the appended claims which alone define the invention.

We claim:

1. The method of injecting fuel into an internal combustion engine comprising the steps of:

increasing the pressure of said fuel to a determined pressure level;

measuring a certain quantity of said pressurized fuel;

delivering to said internal combustion engine said measured certain quantity of pressurized fuel while maintaining the pressure level thereof substantially at said determined pressure level;

expanding and contracting a variable-volume chamber in timed relation to said internal combustion engine to respectively measure said certain quantity of pressurized fuel and to deliver said measured certain quantity of fuel to said internal combustion engine;

reciprocating a pressure-responsive piston member in timed relation to said internal combustion engine to expand and contract said variable-volume chamber;

using said pressure-responsive piston member to open a passage communicating said variable-volume chamber with a source of comparatively low pressure relative to said determined pressure level; and forming abutment means cooperating with said pressure-responsive piston member and with said pressure-responsive plunger member to shift the latter to close said fuel flow path upon a predetermined movement of the former contracting said variable-volume chamber.

2. The method of injecting fuel into a combustion chamber of an internal combustion engine including the steps of:

reciprocably mounting a pressure-responsive valve member between a pair of chambers;

communicating pressurized fuel from a first source thereof having a first pressure level into said pair of chambers;

closing said communication of said pressurized fuel from said first source into one of said pair of chambers in timed relation tc said engine;

sequentially communicating said one chamber to a second source of pressurized fuel having a second pressure level which is less than said first source to shift said valve member to a position communicating fuel into said combustion chamber;

interrupting said communication of pressurized fuel into the other of said pair of chambers in timed relation to said engine;

providing a plunger member having a pair of opposed faces, one of said pair of opposed faces communicating with said other chamber;

communicating pressurized fuel from said first source to the other of said pair of opposed faces to move said plunger member and displace fuel into said combustion chamber past said open valve member;

opening communication of said other chamber with said second source of pressurized fuel upon a determined movement of said plunger member to interrupt communication of fuel to said combustion chamber; and providing abutment means cooperating with said valve member and with said plunger member for moving said valve member to a closed position interrupting communication of fuel to said combustion chamber upon said determined movement of said plunger member.

3. The method of injecting liquid fuel into a combustion chamber of an internal combustion engine, said engine including an injector selectively opening and closing communication of said fuel from a first pressure source thereof to said combustion chamber; said injector including a first chamber communicating with said first pressure source, a second chamber communicating with said first pressure source, and a valve member moving in response to a fluid pressure differential between said first chamber and said second chamber to open communication of said fuel into said combustion chamber, said method including the steps of: interrupting communication of said second chamber with said first pressure source; and communicating said second chamber with a second source of pressurized fuel having a pressure level less than said first pressure source to shift said valve member to an open position communicating fuel into said combustion chamber; said injector further including a third chamber communicating with said first pressure source, said third chamber in said open position of said valve member communicating with said combustion chamber, said method including the step of communicating said third chamber with said second source of pressurized fuel to substantially interrupt communication of fuel from said third chamber to said combustion chamber; reciprocably mounting a plunger member in said third chamber, said plunger member moving to vary the volume defined within said third chamber; moving said plunger member to displace fuel therefrom into said combustion chamber after moving said valve member to said open position; communicating said plunger member with said first chamber whereby pressurized fuel from said first pressure source moves said plunger member to displace fuel from the latter into said combustion chamber past said open valve member; and forming abutment means for cooperating with said plunger member and said valve member to shift the latter to a closed position upon a predetermined movement of said plunger member.

4. The method of injecting a pulse of fuel into an internal combustion engine, said method comprising the steps of:

communicating a first source of pressurized fuel having a first pressure level with a combustion chamber of said engine via a fuel flow path;

reciprocably disposing a first valve member in said flow path, said first valve member moving between a first position closing communication of fuel to said combustion chamber and a second position opening said communication;

drivingly coupling said first valve member with a pressure-responsive plunger member reciprocably mounted between a pair of chambers;

alternately opening and closing communication of one of said pair of chambers with said first pressure source in timed relation with said engine while sequentially communicating the other of said pair of chambers alternately with said first pressure source and with a second source of pressurized fuel having a second pressure level which is less than said first pressure level to move said pressure-responsive valve member to said second position opening said fuel flow path to begin said fuel injection pulse;

communicating said one chamber with said second source of fuel to substantially end said fuel injection pulse;

forming a branch of passage in said fuel flow path between said first and said second valve members;

reciprocably mounting a piston member between a pair of cavities, one of said pair of cavities communicating with said branch passage, the other of said pair of cavities communicating with said first pressure source;

moving said piston member through a determined distance to displace fuel from said one cavity into said combustion chamber via said branch passage during said fuel injection pulse; and forming abutment means cooperating with said plunger member and said piston member to move said first valve member to said first position upon said piston member moving through said determined distance, thereby closing said fuel flow path and ending said fuel injection pulse.

5. Fuel injection apparatus comprising:

means for increasing the pressure level of fuel from ambient pressure to a determined pressure level;

means for measuring out a certain quantity of said pressurized fuel at said determined pressure level;

means for delivering said measured certain quantity of pressurized fuel to an internal combustion engine while maintaining the pressure level thereof substantially at said determined pressure level;

said injection apparatus including a fuel injector defining an inlet receiving pressurized fuel from said pressure increasing means, a nozzle section opening to a combustion chamber of said engine, and a fuel flow path extending between said inlet and said nozzle section;

said measuring means comprising said fuel injector defining a bore communicating with said fuel flow path, said bore reciprocably receiving a piston member cooperating with said fuel injector to define a pair of variable-volume cavities, one of said pair of variable-volume cavities communicating with said fuel flow path, and means for moving said piston member to increase the volume of said one variable-volume cavity to measure said certain quantity of pressurized fuel therein;

said means for moving said piston member including the latter defining a differential area and a pair of opposed faces differing in effective area according to said differential area, the larger of said pair of opposed faces being exposed to said one variable-volume cavity, the smaller of said pair of opposed faces being exposed to the other of said pair of variable-volume cavities and said differential area being exposed to ambient pressure;

operator-operated variable stop means for cooperating with said piston member to limit the movement thereof in a direction expanding said one variable-volume cavity, whereby pressurized fuel communicating to said larger face of said piston member moves the latter into engagement with said variable stop means to measure said certain quantity of pressurized fuel into said one variable-volume cavity;

said piston member defining a stem sealingly and movably extending through an end wall of said bore, said stem defining said differential area; and one of said piston member and stem defining a passage opening communication between said pair of variable-volume cavities upon a predetermined movement of said piston member in a direction contracting said one variable-volume cavity.

6. Fuel injection apparatus comprising:

means for increasing the pressure level of fuel from ambient pressure to a determined pressure level;

means for measuring out a certain quantity of said pressurized fuel at said determined pressure level; and means for delivering said measured certain quantity of pressurized fuel to an internal combustion engine while maintaining the pressure level thereof substantially at said determined pressure level;

said injection apparatus including a fuel injector defining an inlet receiving pressurized fuel from said pressure increasing means, a nozzle section opening to a combustion chamber of said engine, and fuel flow path extending between said inlet and said nozzle section;

said measuring means comprising said fuel injector defining a bore communicating with said fuel flow path, said bore reciprocably receiving a piston member cooperating with said fuel injector to define a pair of variable-volume cavities, one of said pair of variable-volume cavities communicating with said fuel flow path, and means for moving said piston member to increase the volume of said one variable-volume cavity to measure said certain quantity of pressurized fuel therein;

said means for moving said piston member including the latter defining a differential area and a pair of opposed faces differing in effective area according to said differential area, the larger of said pair of opposed faces being exposed to said one variable-volume cavity, the smaller of said pair of opposed faces being exposed to the other of said pair of variable-volume cavities and said differential area being exposed to ambient pressure;

operator-operated variable stop means for coooperating with said piston member to limit the movement thereof in a direction expanding said one variable-volume cavity, whereby pressurized fuel communicating to said larger face of said piston member moves the latter into engagement with said variable stop means to measure said certain quantity of pressurized fuel into said one variable-volume cavity;

said means for delivering said measured certain quantity of pressurized fuel to said combustion chamber including passage means communicating pressurized fuel from said inlet to said other variable-volume cavity, first valve means for closing communication of pressurized fuel from said inlet to said one variable-volume cavity, and second valve means for in an open position thereof opening communication of said measured certain quantity of fuel from said one variable-volume cavity to said combustion chamber, pressurized fuel in said other variable-volume cavity moving said piston member to contract said one variable-volume cavity and displace pressurized fuel therefrom into said combustion chamber;

said second valve means being drivingly coupled with a pressure-responsive plunger member defining a pair of opposed surfaces exposed to pressurized fuel at said determined pressure level, said first valve member closing communication of pressurized fuel at said determined pressure level to one of said pair of opposed surfaces and sequentially communicating said one surface to a source of comparatively low pressure relative to said determined pressure level to shift said second valve member to said open position; and cooperating abutment means for cooperating with said plunger member and piston member upon a predetermined movement of the latter contracting said one variable-volume cavity.

7. Fuel injection apparatus comprising:

a fuel injector defining an inlet communicable with a first source of pressurized fuel to receive fuel therefrom at a first pressure level, a nozzle section communicable with a combustion chamber of an internal combustion engine, and a fuel flow path extending from said inlet to open on said nozzle section;

first pressure-responsive valve means reciprocably disposed in said fuel flow path for opening and closing the latter in respective positions of said first valve means, said first valve means defining a pair of opposed faces, one of said pair of opposed faces being exposed to said fuel flow path and the other of said pair of opposed faces being sealingly isolated therefrom, said first valve means in said closed position thereof further defining a differential area exposed to said combustion chamber, said first valve means closing said flow path in response to communication of pressurized fuel at said first pressure level to said other face, said first valve means shifting to said open position in response to communication of said other face to a second source of pressurized fuel having a second pressure level which is less than said first pressure level;

second pressure-responsive valve means for opening and closing said fuel flow path upstream of said first valve means in respective positions of said second valve means, said second valve means in said open position thereof communicating said other face with said first source of pressurized fuel and in said closed position thereof communicating said other face with said second source of pressurized fuel;

means for driving said second valve means between said open and closed positions thereof in timed relation with said engine;

pressure-responsive piston means moving to respectively expand and contract a variable-volume cavity in response to receipt of pressurized fuel at said first pressure level and relief of said pressurized fuel therefrom;

passage means extending from said variable-volume cavity to said fuel flow path intermediate of said first and second valve means for communicating pressurized fuel therebetween;

said piston means moving to receive pressurized fuel into said variable-volume cavity when said first and said second valve means are in closed and open positions respectively, said piston means moving to displace said pressurized fuel into said combustion chamber when said first and second valve means reverse positions;

said first valve means including a valve element sealingly cooperable with said nozzle section to close said fuel flow path, a plunger member defining said pair of opposed faces, and a stem drivingly coupling said plunger member with said valve element, said valve element defining said differential area for said first valve means whereby pressurized fuel at said first pressure level communicating to said other face opposes fluid pressure in said combustion chamber communicating to said differential area thereby to maintain said first valve member in said closed position.

8. Fuel injection apparatus comprising:

a fuel injector defining an inlet communicable with a first source of pressurized fuel to receive fuel therefrom at a first pressure level, a nozzle section communicable with a combustion chamber of an internal combustion engine, and a fuel flow path extending from said inlet to open on said nozzle section;

first pressure-responsive valve means reciprocably disposed in said fuel flow path for opening and closing the latter in respective positions of said first valve means, said first valve means defining a pair of opposed faces, one of said pair of opposed faces being exposed to said fuel flow path and the other of said pair of opposed faces being sealingly isolated therefrom, said first valve means in said closed position thereof further defining a differential area exposed to said combustion chamber, said first valve means closing said flow path in response to communication of pressurized fuel at said first pressure level to said other face, said first valve means shifting to said open position in response to communication of said other face to a second source of pressurized fuel having a second pressure level which is less than said first pressure level;

second pressure-responsive valve means for opening and closing said fuel flow path upstream of said first valve means in respective positions of said second valve means, said second valve means in said open position thereof communicating said other face with said first source of pressurized fuel and in said closed position thereof communicating said other face with said second source of pressurized fuel;

means for driving said second valve means between said open and closed positions thereof in timed relation with said engine;

pressure-responsive piston means moving to respectively expand and contract a variable-volume cavity in response to receipt of pressurized fuel at said first pressure level and relief of said pressurized fuel therefrom;

passage means extending from said variable-volume cavity to said fuel flow path intermediate of said first and second valve means for communicating pressurized fuel therebetween;

said piston means moving to receive pressurized fuel into said variable-volume cavity when said first and said second valve means are closed and open positions respectively, said piston means moving to displace said pressurized fuel into said combustion chamber when said first and second valve means reverse positions; and abutment means for cooperating with said first valve means and with said piston means upon a predetermined movement of the latter contracting said variable-volume cavity, said abutment means moving said first valve means to said closed position thereof.

9. The method of injecting fuel into an internal combustion engine comprising the steps of:

increasing the pressure of said fuel to a determined pressure level;

measuring a certain quantity of said pressurized fuel;

delivering to said internal combustion engine said measured certain quantity of pressurized fuel while maintaining the pressure level thereof substantially at said determined level;

expanding and contracting a variable-volume chamber in timed relation to said internal combustion engine to respectively measure said certain quantity of pressurized fuel and to deliver said measured certain quantity of fuel to said internal combustion engine;

reciprocating a pressure-responsive piston member in timed relation to said internal combustion engine to expand and contract said variable-volume chamber;

using pressurized fuel having said determined pressure level to reciprocate said pressure-responsive piston member;

exposing a differential area defined by said pressure-responsive piston member to a first source of comparatively low pressure relative to said determined pressure level;

communicating pressurized fuel having said determined pressure level to a pair of opposed faces defined by said pressure-responsive piston member, said pair of opposed faces differing in effective are substantially according to said differential area, said pressurized fuel moving said pressure-responsive piston member to expand said variable-volume chamber;

closing communication of said pressurized fuel having said determined pressure level to the one of said opposed faces of said piston member having the larger area;

communicating said one face of said piston member to a second source of comparatively low pressure relative to said determined pressure level, pressurized fuel communicating to the other of said opposed faces of said piston member moving said pressure-responsive piston member to contract said variable-volume chamber;

using said one face of said pressure-responsive piston member to bound said variable-volume chamber;

forming a fuel flow path leading from a source of pressurized fuel having said determined pressure level to a combustion chamber of said internal combustion engine;

closing said fuel flow path with a valve element movable to open said flow path;

drivingly coupling said valve element with a pressure-responsive reciprocable plunger member;

using pressurized fuel substantially at said determined pressure level to reciprocate said plunger member opening and closing said fuel flow path;

forming a branch passage leading from said fuel flow path upstream of said valve element to said variable-volume chamber; and using a valve member reciprocating in timed relation with said engine to open and close said fuel flow path upstream of said branch passage.

10. The method of injecting fuel into a combustion chamber of internal combustion engine including the steps of:

reciprocably mounting a pressure-responsive valve member between a pair of chambers;

communicating pressurized fuel from a first source thereof having a first pressure level into said pair of chambers;

closing said communication of said pressurized fuel from said first source into one of said pair of chambers in timed relation to said engine;

sequentially communicating said one chamber to a second source of pressurized fuel having a second pressure level which is less than said first source to shift said valve member to a position communicating fuel into said combustion chamber;

interrupting said communication of pressurized fuel into the other of said pair of chambers in timed relation to said engine, providing a plunger member having a pair of opposed faces, one of said pair of opposed faces communicating with said other chamber;

communicating pressurized fuel from said first source to the other of said pair of opposed faces to move said plunger member and displace fuel into said combustion chamber past said open valve member; and using a valve apparatus moving in timed relation with said engine to open and close communication of pressurized fuel from said first source with said other chamber while sequentially communicating said one chamber alternately with said first source and with said second source.

11. Fuel injection apparatus comprising:

means for increasing the pressure level of fuel from ambient pressure to a determined pressure level;

means for measuring out a certain quantity of said pressurized fuel at said determined pressure level; and means for delivering said measured certain quantity of pressurized fuel to an internal combustion engine while maintaining the pressure level thereof substantially at said determined pressure level;

said injection apparatus including a fuel injector defining an inlet receiving pressurized fuel from said pressure increasing means, a nozzle section opening to a combustion chamber of said engine, and a fuel flow path extending between said inlet and said nozzle section;

said measuring means comprising said fuel injector defining a bore communicating with said fuel flow path, said bore reciprocably receiving a piston member cooperating with said fuel injector to define a pair of variable-volume cavities, one of said pair of variable-volume cavities communicating with said fuel flow path, and means for moving said piston member to increase the volume of said one variable-volume cavity to measure said certain quantity of pressurized fuel therein;

said means for moving said piston member includes the latter defining a differential area and a pair of opposed faces differing in effective area according to said differential area, the larger of said pair of opposed faces being exposed to said one variable-volume cavity, the smaller of said pair of opposed faces being exposed to the other of said pair of variable-volume cavities and said differential are being exposed to ambient pressure;

operator-operated variable stop means for cooperating with said piston member to limit the movement thereof in a direction expanding said one variable-volume cavity, whereby pressurized fuel communicating to said larger face of said piston member moves the latter into engagement with said variable stop means to measure said certain quantity of pressurized fuel into said one variable-volume cavity;

said piston member defining a stem sealingly and movably extending through an end wall of said bore, said stem defining said differential area.

12. Fuel injection apparatus for injecting fuel into a combustion space of an internal combustion engine in phased relation with operation thereof, said apparatus comprising a pressure-responsive plunger member moving to displace fuel into said combustion space via a flow path, abutment means associating with the plunger member and with a valve member to move the latter to a position closing said flow path to stop said fuel displacement upon a determined movement of said plunger member, and phase change means for changing the phase relationship of said engine and said injection apparatus, said phase change means comprising a link member pivotal about an axis and oscillatorily driven by said engine to reciprocate a control member of said fuel injection apparatus, and rotatable eccentric means for defining said pivot axis, said eccentric means being selectively rotatable to move said pivot axis relative said control member.

13. The method of claim 2 further including the steps of:

sequentially opening communication of pressurized fuel from said first source to said other chamber and to said one face of said plunger member after closing of said valve member;

forming a differential area on said plunger member; and exposing said differential area to a fluid pressure having a pressure level less than said first source to move said plunger member through said determined movement in the opposite direction.

14. The method of claim 13 further including the steps of:

sequentially opening communication of pressurized fuel from said first source to said one chamber after closing of said valve member;

forming a differential area on said valve member, said differential area being isolated from said pressurized fuel in said pair of chambers to bias said valve member to said closed position.

15. The invention of claim 3 wherein said method includes the step of forming a differential area on said plunger member, and exposing said differential area to a comparatively low fluid pressure relative to said first and said second sources to move said plunger member through said predetermined movement to refill said third chamber with pressurized fuel from said first pressure source.

16. The invention of claim 6 wherein said piston member is annular and circumscribes said plunger member.

17. The invention of claim 16 wherein said cooperating abutment means includes a radial enlargement defined by said plunger member and an end edge defined by said piston member and engageable with said radial enlargement.

18. The invention of claim 7 wherein said cooperating abutment means includes a shuttle member reciprocably mounted in said fuel injector and defining a pair of opposite ends respectively engageable with said piston member and with said plunger member.

19. The invention of claim 7 wherein said second valve means includes a valve member defining a differential area and a pair of opposed faces differing in effective area according to said differential area, said pair of opposed faces communicating with pressurized fuel at said first pressure level and said differential area communicating with substantialy ambient pressure to bias said valve member toward one of said open and said closed positions.

20. The invention of claim 19 wherein said valve member traverses a passage to open and close said fuel flow path.

21. The invention of claim 19 wherein said valve member defines a circumferential groove defining a pair of spaced apart valving edges, said circumferential groove communicating with said other face, and said valving edges moving with respect to a pair of passages defined by said fuel injector to communicate said other face with said first source of pressurized fuel in said open position of said valve member and communicating said other face with said second source of pressurized fuel in said closed position of said valve member.

22. The invention of claim 19 wherein said valve member includes a stem defining said differential area.

23. The invention of claim 22 wherein pressurized fuel communicating with said pair of opposed faces biases said valve member to continuously engage said stem with said means for driving said second valve means.

24. The invention of claim 19 wherein said pressure-responsive piston means includes a piston member defining a differential area and a pair of opposed surfaces differing in effective area according to said differential area, the larger of said pair of opposed surfaces being exposed to said variable-volume cavity, the other of said pair of opposed surfaces being exposed to pressurized fuel at said first pressure level, and said differential area being exposed to substantially ambient pressure.

25. The invention of claim 24 wherein said piston member includes a piston stem defining said differential area of said piston member, said fuel injector further including operator-operated variable stop means for engaging said piston stem to limit movement of said piston member in a direction expanding said variable-volume cavity.

26. The invention of claim 25 wherein said variable-stop means includes an operator-operable cam member engaging said piston stem.

27. The invention of claim 22 wherein said means for driving said second valve means in timed relation with said engine includes a rotatable cam element driven by said engine and drivingly cooperating with said stem.

28. The invention of claim 27 wherein said fuel injector includes operator-operable variable-phasing means cooperating with said cam element and with said stem for selectively changing the phase relationship between said fuel injector and said engine.

29. The invention of claim 28 wherein said variable-phasing means includes a lever member driven by said cam element and driving said piston stem, said lever member being pivotally carried upon a movable eccentric member defining the fulcrum of said lever member.

30. The invention of claim 19 wherein said second source of pressurized fuel having said second pressure level includes a vent regulator, said vent regulator comprising a stepped piston defining a small diameter end exposed to pressurized fuel at said first pressure level, said stepped piston further defining a large diameter end exposed to a compartment receiving pressurized fuel, said stepped piston member moving with respect to a passage opening to substantially ambient pressure to open and close said passage to maintain the pressure level of said compartment at said second pressure level.

31. The invention of claim 30 wherein said small diameter end defines an effective area equal to substantially fourty-four percent of the effective area defined by said large diameter end.

32. The invention of claim 19 wherein said pressure-responsive piston means defines a passage opening communication between said second source of pressurized fuel and said variable-volume cavity upon a predetermined movement of said piston means contracting said variable-volume cavity.

33. The invention of claim 8 wherein said piston means is annular and circumscribes said first valve means.

34. The invention of claim 33 wherein said cooperating abutment means includes said first valve means defining a radial enlargement and said piston means defining an end edge engageable with said radial enlargement.

35. The invention of claim 8 wherein said cooperating abutment means includes a shuttle member reciprocably mounted in said fuel injector between said first valve means and said piston means, said shuttle member being engageable with said first valve means and with said piston means.

36. The method of claim 9 including the step of:

using said valve member to open and close communication of pressurized fuel at said determined pressure level to one of a pair of opposed faces defined by said plunger member in timed relation to said engine.

37. The method of claim 36 including the step of using said valve member to sequentially open communication of said one face of said plunger member to a source of comparatively low pressure relative to said determined pressure level shifting said plunger member to open said fuel flow path.

38. The invention of claim 11 wherein said operator-operated variable stop means comprises a rotatable cam member cooperating with said piston member to limit the movement thereof in a direction expanding said one variable-volume cavity.

39. The invention of claim 38 wherein said means for delivering said measured certain quantity of pressurized fuel to said combustion chamber includes passage means communicating pressurized fuel from said inlet to said other variable-volume cavity, first valve means for closing communication of pressurized fuel from said inlet to said one variable-volume cavity, and second valve means for in an open position thereof opening communication of said measured certain quantity of fuel from said one variable-volume cavity to said combustion chamber, pressurized fuel in said other variable-volume cavity moving said piston member to contract said one variable-volume cavity and displace pressurized fuel thereform into said combustion chamber.

40. The invention of claim 39 wherein said second valve means is drivingly coupled with a pressure-responsive plunger member defining a pair of opposed surfaces exposed to pressurized fuel at said determined pressure level, said first valve member closing communication of pressurized fuel at said determined pressure level to one of said pair of opposed surfaces and sequentially communicating said one surface to a source of compartively low pressure relative to said determined pressure level to shift said second valve member to said open position.

* * * * *